United States Patent [19]

Masuda

[11] Patent Number: 5,017,947

[45] Date of Patent: May 21, 1991

[54] LIQUID EJECTION RECORDING HEAD HAVING A SUBSTRATE SUPPORTING A WALL PORTION WHICH INCLUDES SUPPORT WALLS TO FORM OPEN CHANNELS THAT SECURELY BOND A LID MEMBER TO THE WALL PORTION

[75] Inventor: Kazuaki Masuda, Hiratsuka, Japan

[73] Assignee: Canon Kabushiki Kaisha, Tokyo, Japan

[21] Appl. No.: 394,166

[22] Filed: Aug. 14, 1989

Related U.S. Application Data

[63] Continuation of Ser. No. 240,483, Sep. 6, 1988, abandoned, which is a continuation of Ser. No. 57,741, Jun. 3, 1987, abandoned, which is a continuation of Ser. No. 711,181, Mar. 13, 1985, abandoned.

[30] Foreign Application Priority Data

Mar. 31, 1984 [JP] Japan ..... 59-64106

[51] Int. Cl.[5] ..... B41J 2/05

[52] U.S. Cl. ..... 346/140 R; 156/87

[58] Field of Search ..... 346/140; 156/87

[56] References Cited

U.S. PATENT DOCUMENTS

| | | | |
|---|---|---|---|
| 4,394,670 | 7/1983 | Sugitani et al. | 346/140 R |
| 4,509,063 | 4/1985 | Sugitani | 346/140 |
| 4,521,787 | 6/1985 | Yokota | 346/140 |
| 4,596,905 | 6/1986 | Fowler . | |
| 4,698,645 | 10/1987 | Inamoto | 346/140 |

FOREIGN PATENT DOCUMENTS

| | | |
|---|---|---|
| 0095911 | 12/1983 | European Pat. Off. . |
| 3200388 | 12/1982 | Fed. Rep. of Germany . |
| 3326781 | 1/1984 | Fed. Rep. of Germany . |
| 0118873 | 9/1980 | Japan . |
| 2104453 | 3/1983 | United Kingdom . |
| 2134852 | 8/1984 | United Kingdom . |
| 2134853 | 8/1984 | United Kingdom . |
| 2156741 | 10/1985 | United Kingdom . |

*Primary Examiner*—Joseph W. Hartary

*Attorney, Agent, or Firm*—Fitzpatrick, Cella, Harper & Scinto

[57] ABSTRACT

A liquid ejection recording head comprises a supporting substrate having energy generating elements thereon, a lid member and a wall portion between the supporting substrate and the lid member. The wall portion includes a surrounding wall that forms a liquid chamber between the substrate and the lid member and an enclosing wall disposed around the surrounding wall that provides a gap between the surrounding and enclosing walls, which gap is in communication with the exterior of the head through an opening in the enclosing wall. The wall portion also includes a plurality of substantially similar, parallel wall members, a first plurality of which forms an array of flow paths from the liquid chamber to orifices for discharging liquid when the energy generating elements are actuated and a second plurality of which forms open channels not in communication with the liquid chamber but in communication with the exterior of the recording head. The wall portion enables a secure bond to be made with the lid member, since it presents sufficient contact area for bonding, while the open channels and gap prevent air from being trapped between the lid member and substrate during assembly of the head.

41 Claims, 4 Drawing Sheets

LIQUID EJECTION RECORDING HEAD HAVING A SUBSTRATE SUPPORTING A WALL PORTION WHICH INCLUDES SUPPORT WALLS TO FORM OPEN CHANNELS THAT SECURELY BOND A LID MEMBER TO THE WALL PORTION

This application is a continuation of application Ser. No. 07/240,483 filed Sept. 6, 1988, now abandoned, which in turn is a continuation of application Ser. No. 07/057,741, filed June 3, 1987, now abandoned, which in turn is a continuation of application Ser. No. 06/711,181, filed Mar. 13, 1985, now abandoned.

BACKGROUND OF THE INVENTION

1. Field of the Invention

This invention relates to a liquid ejection recording head, and more particularly to a liquid ejection recording head, particularly an ink jet recording head, in which liquid flow path walls formed of a hardened film of photosensitive resin and/or walls surrounding a liquid chamber are formed on the surface of a substrate on which liquid discharge energy generating elements are installed and a lid plate is provided on top thereof.

2. Description of the Prior Art

A liquid ejection recording head applied to the ink jet recording system is generally provided with minute ink discharge ports (orifices), ink paths and ink discharge energy generating portions provided in a part of the ink paths.

As a method of making such a conventional ink jet recording head, there is known, for example, a method of forming minute grooves in a support member of glass or metal by cutting or etching, thereafter joining the support member formed with the grooves to another suitable plate and forming ink paths.

However, in the head made by such a method, the roughness of the inner wall surfaces of the liquid paths worked by cutting is too great or distortion is created in the liquid paths due to variations in etching rate and thus, it is difficult to obtain liquid paths of a constant path resistance and irregularity is liable to occur to the ink discharge characteristic of the recording head during its use. Also, during the cutting work, breakage or planing of the plate is liable to occur and therefore, the yield of manufacture is low and on the other hand, when effecting the etching work, there are involved a number of manufacturing steps, which results in an increased cost of manufacture.

Further, a disadvantage common to the conventional methods is that when a grooved plate formed with liquid flow paths is to be cemented to a plate provided with driving elements such as electro-mechanical converting members (for example, piezo-electric elements) or electro-thermal converting members (for example, heat generating elements) as ink discharge energy generating elements which generate the energy acting on ink to eject the ink from the orifices and form flying droplets, it is difficult to align these plates and this is unsuitable for mass production.

So, as a liquid ejection recording head constructed to overcome these disadvantages, a liquid ejection recording head in which liquid flow path walls formed of a photosensitive resin hardening film are formed on a substrate on which ink discharge energy generating elements are disposed and a lid plate is provided on the flow paths is proposed, for example, by Japanese Laid-Open Patent Application No. 43876/1982.

This liquid ejection recording head made by the utilization of photosensitive resin is excellent in solving the disadvantages peculiar to the conventional heads that the finish accuracy of the liquid flow paths is low, that the manufacturing steps are complicated and that the yield of manufacture is low.

FIGS. 1 and 2 of the accompanying drawings show two forms of such a conventional liquid ejection recording head. In these Figures, reference numeral 1 designates a support member formed of glass, ceramics, plastics or a metal. Reference numeral 2 denotes a plurality of (nine in the case of the present example) liquid discharge energy generating elements disposed on the support member 1. As the discharge energy generating elements 2, use is made of heat generating elements or piezo-electric elements. Wiring for signal inputting, not shown, is connected to these elements 2. In the case of the heat generating elements, the liquid near the elements in liquid flow paths 3 in which individual elements 2 are provided is sharply heated, whereby the energy for discharging the ink is generated and the ink is discharged from discharge ports 4 formed at the end of the flow paths 3.

Also, where the discharge energy generating elements 2 are piezo-electric elements, the discharge energy for discharging the ink is likewise generated by mechanical vibration of these elements, whereby discharge of the ink can be accomplished.

Reference numeral 5 designates a liquid chamber communicating with the individual liquid flow paths 3. A surrounding wall 6B is formed around the liquid chamber 5, and flow path walls 6A are formed between the flow paths 3. The surrounding wall 6B and flow path walls 6A may be formed of a photosensitive resin hardening film by photolithography, i.e., photoengraving.

A lid plate 7 is mounted on the substrate 1 on which the flow paths 3 and liquid chamber 5 are formed in this manner. The lid plate 7 is generally formed of glass, ceramics, plastics or a metal and, for example, a photosensitive resin layer 8 is formed on the joined surface of the lid plate 7.

The formation of such a layer 8 may be achieved by applying photosensitive resin liquid to the lid plate 7 by the spinner coating method or by laminating photosensitive resin dry films on the lid plate 7. Designated by 9 are liquid supply ports formed in the lid plate 7. Thus, a recording head 10 is provided by joining the lid plate 7 formed with the photosensitive resin layer 8 and supply ports 9 to the upper surfaces of the surrounding wall 6B and flow path walls 6A.

The example shown in FIG. 1 and the example shown in FIG. 2 are similar to each other with the exception that they differ in the shape of a part of the surrounding wall 6B and flow path walls 6A, and the liquid ejecting operation in the recording head 10 provided in this manner is generally known and therefore need not be described.

However, in the conventional recording head made by the utilization of such photosensitive resin, when adhesively securing the flow path walls 6A formed of a photosensitive resin hardening film and the wall 6B for ink reservoir connected to the flow path walls to the lid plate of hardening film, it has been technically difficult to bring them into completely intimate contact with each other over the entire joined surface thereof and therefore, specifically, the procedures as described below have been resorted to.

(1) Uniformly applying an epoxy adhesive agent or an acrylic adhesive agent to a thickness of 3–4 μm to the joined surface of the lid plate formed of a material such as glass, ceramics, a metal or plastics, by the spinner coating method and joining it to the upper surface of the wall of photosensitive resin hardening film, thereby hardening said adhesive agent;

(2) Spinner-coating the joined surface of the lid plate 7 with said adhesive agent, and then preliminarily heating the adhesive agent to make it into B-stage, and joining the lid plate to the upper surface of the walls formed of a photosensitive resin hardening film, thereby essentially hardening said adhesive agent;

(3) Directly thermally fusing the lid plate 7 formed of a thermoplastic resin material such as acrylic resin, ABS resin or polyethylene to the upper surface of the walls of the photosensitive resin hardening film; and (4) Sticking a photosensitive resin layer to the joined surface of said lid plate, joining it to the upper surface of the walls of said photosensitive resin hardening film, and applying a light thereto, thereby hardening the same.

However, with any of the procedures as described above, bubbles may remain on the joined surface between the upper surface of the walls formed of the photosensitive resin hardening film and the lid plate 7. Also, when the two joined members are strongly pressed against each other to bring them into intimate contact with each other, the adhesive agent and the photosensitive resin provided on the joined surface of the lid plate 7 will protrude into the liquid flow paths 4 to clog the liquid flow paths 4, and this has left a problem as to the reliability of the joined surface.

Also, even when the adhesion has been done completely, stress and distortion have been created by the difference in adhesion strength resulting from the difference in area of adhesion, and this has sometimes led to the occurrence of peeling-off of the lid plate or distortion of the recording head.

SUMMARY OF THE INVENTION

The present invention has been made in view of the above-noted disadvantages and an object thereof is to provide a liquid ejection recording head free of drawbacks and high in reliability in which the intimate contact and fixing of liquid flow path walls formed of a hardened film of photosensitive resin on the surface of a substrate and a liquid chamber surrounding wall connected thereto with a lid plate joined to the upper surface of these walls is accomplished in a good state over the entire joined surface.

Another object of the present invention is to provide a liquid discharge recording head in which wall portions are formed of a hardened film of photosensitive resin between a substrate and a lid plate disposed parallel to and covering the substrate and liquid flow paths and a liquid chamber communicating with the liquid flow paths are formed by said wall portions and wherein the maximum width of said wall portions is two times or less the minimum width of said wall portions.

DESCRIPTION OF THE PREFERRED EMBODIMENT

An embodiment of the present invention will hereinafter be described with reference to the drawings.

Figure 3:
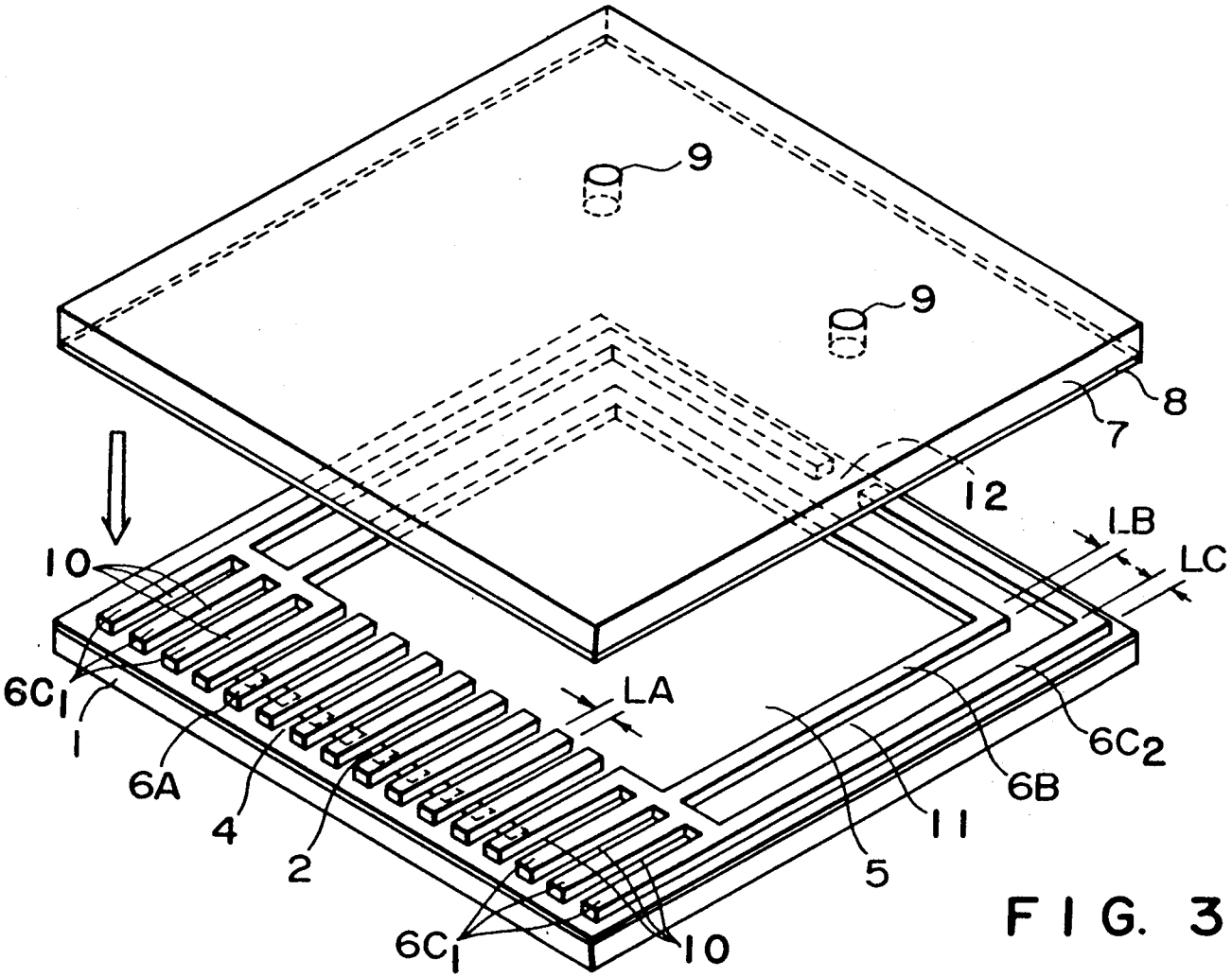
FIG. 3 is an exploded perspective view showing an example of the construction of the liquid discharge recording head of the present invention.

In the present embodiment, of the previously described cementing procedures, the procedures of providing a photosensitive resin layer on the joined surface of a lid plate, joining it to the upper surface of a wall portion formed of a photosensitive resin hardening film, and sensitizing-hardening it are adopted. FIG. 3 shows an embodiment of the present invention. Reference numeral 1 designates a supporting substrate formed of glass or ceramics. A desired number of liquid discharge energy generating elements 2 are disposed on the substrate 1, and a wiring portion for signal inputting, not shown, is connected to these elements 2.

Reference characters 6A, 6B and 6C denote, a wall portion formed of photosensitive resin hardening film. The walls 6C comprise, which form grooves having external orifices closed to the liquid chamber 5 but open to the exterior of the recording head, support walls which are not in direct contact with liquid but are provided at necessary positions from the view point of the joining to the lid plate or member 7, and the photosensitive resin hardening film forming the wall portion 6A, 6B and 6C can be made by the well-known photolithography method. It will be readily appreciated from FIG. 3 that the flow path walls 6A and the corner support walls $6C_1$, respectively constitute first and second pluralities of substantially similar, parallel wall members that provide, first, an array of flow paths and, second, like numbers of open channels 10 at both ends of the flow path array. The channels 10 are maintained out of communication with the liquid chamber 5, but are open to the exterior of the recording head. An enclosing wall $6C_2$ extends around the surrounding wall 6B with a gap 11 therebetween, the gap 11 being in communication with the exterior of the recording head through an opening 12 in the enclosing wall $6C_2$.

Figure 1:
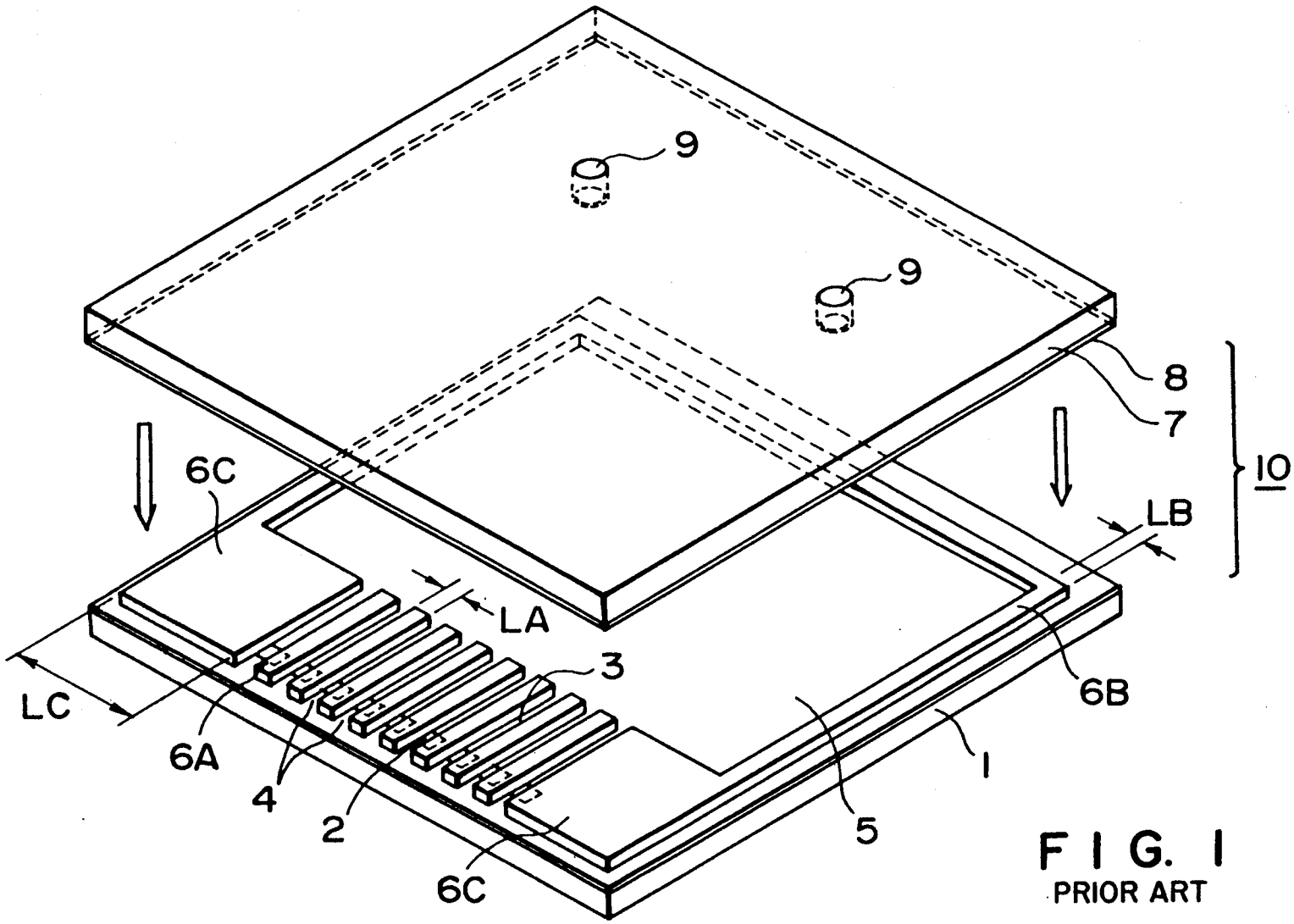
FIG. 1 PRIOR ART
FIGS. 1 and 2 are exploded perspective views showing two forms of the construction of a liquid discharge recording head according to the prior art.

In the present embodiment, the wall widths LA, LB and LC of the wall portion 6A, 6B and 6C are substantially equal to one another. That is, in the case of FIG. 1, the wall width LA of the flow path wall 6A and the wall width LB of the surrounding wall 6B of the liquid chamber 5 have been substantially equal to each other, but the wall width LC of the corner wall 6C of the corner portion intervening between the flow path wall 6A and the surrounding wall 6B has been remarkably great.

Figure 2:
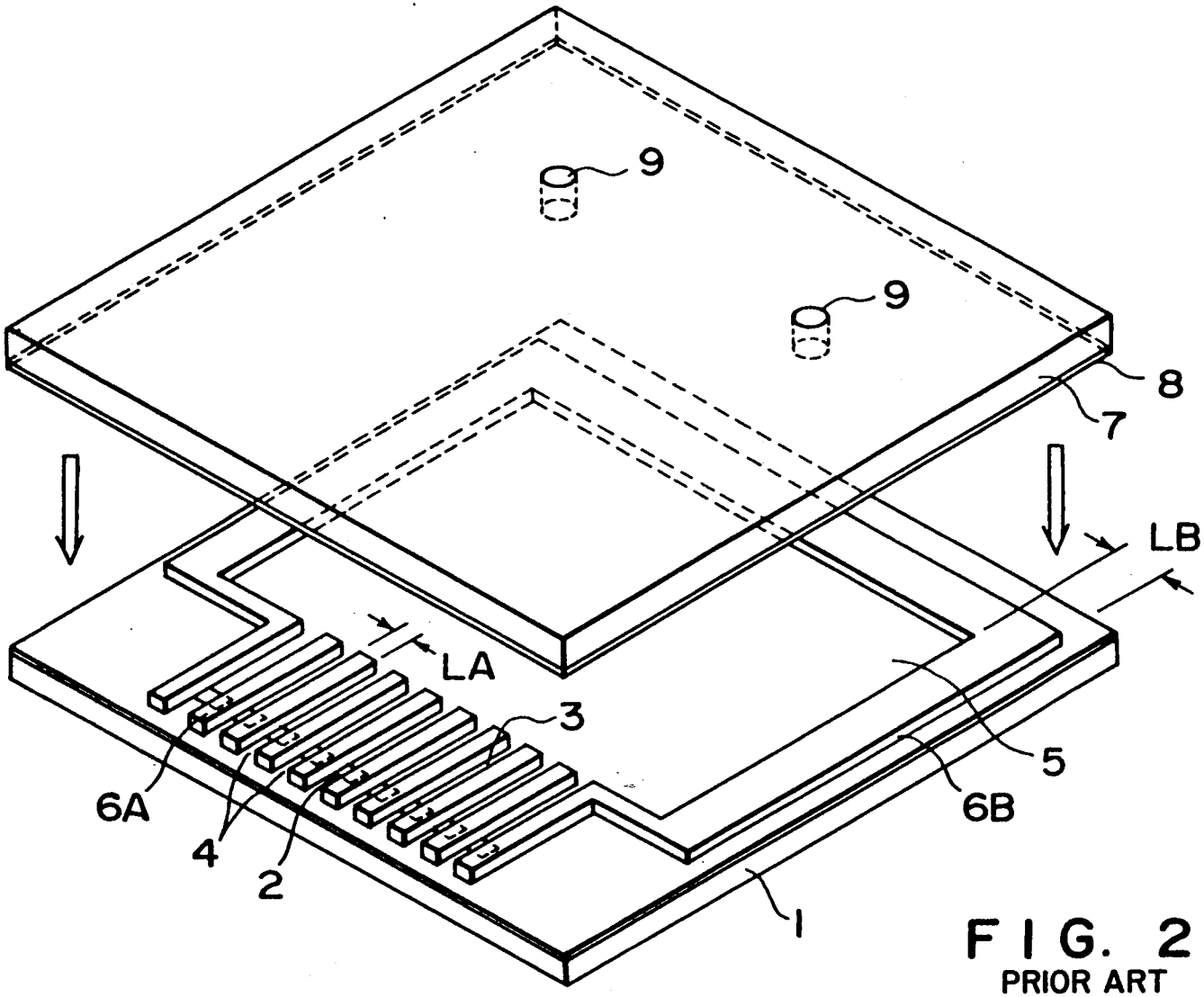
FIG. 2 PRIOR ART

Also, in the case of FIG. 2, the wall width LA of the flow path wall 6A and the wall width LB of the surrounding wall 6B have been different from each other and the wall width LB has been greater than the wall width LA.

In contrast, in the present invention, these wall widths have been made substantially equal to each other, whereby it has become possible to eliminate the drawback of the joined portion as will later be described.

Reference numeral 7 designates a lid plate formed of glass or ceramics, and reference numeral 8 denotes a layer of photosensitive resin. When joining the lid plate 7 formed with the layer 8 to the upper surfaces of the wall portions 6A, 6B and 6C, use may be made of a method similar to that described in connection with the prior art.

Paying attention to the fact that such conditions regarding the wall widths greatly affect the occurrence of the drawback of the joined portion, the inventor carried out cementing experiments by varying the widths of the individual walls formed of the aforementioned photosensitive resin hardening film when joining the lid plate to the substrate.

The cementing conditions and the result of the examination of the state after cementing will be shown in Table 1 below.

TABLE 1

| | Cementing conditions (Ten samples for each condition) | | | | | Result of examination of cementing conditions (Average value of ten samples) | | | |
|---|---|---|---|---|---|---|---|---|---|
| | Width of each wall of photosensitive resin hardening film | | | | | Number of drawbacks by joined regions | | | Total number |
| No. | LA | LB | LC | Pressure of Cementing | Other conditions | Portion 3a | Portion 3b | Portion 3c | of drawbacks |
| 1 | 100(μ) | 500(μ) | 1000(μ) | 1.0 (Kg/cm2) | a glass plate | 0 | 72 | 60 | 132 |
| 2 | " | 300 | — | " | of t = 0.7 mm | 0 | 41 | — | 41 |
| 3 | " | 200 | 200 | " | was used as | 0 | 2 | 2 | 4 |
| 4 | " | 100 | 100 | " | the cover. | 0 | 1 | 1 | 2 |
| 5 | " | 50 | 50 | " | | 0 | 0 | 0 | 0 |
| 6 | 50 | 500 | 1000 | " | | 0 | 95 | 82 | 177 |
| 7 | " | 300 | — | " | | 0 | 70 | — | 70 |
| 8 | " | 200 | — | " | | 0 | 18 | — | 18 |
| 9 | " | 100 | 100 | " | | 0 | 0 | 1 | 1 |
| 10 | " | 50 | 50 | " | | 0 | 0 | 0 | 0 |
| 11 | " | 25 | 25 | " | | 0 | 0 | 0 | 0 |

Figure 4:
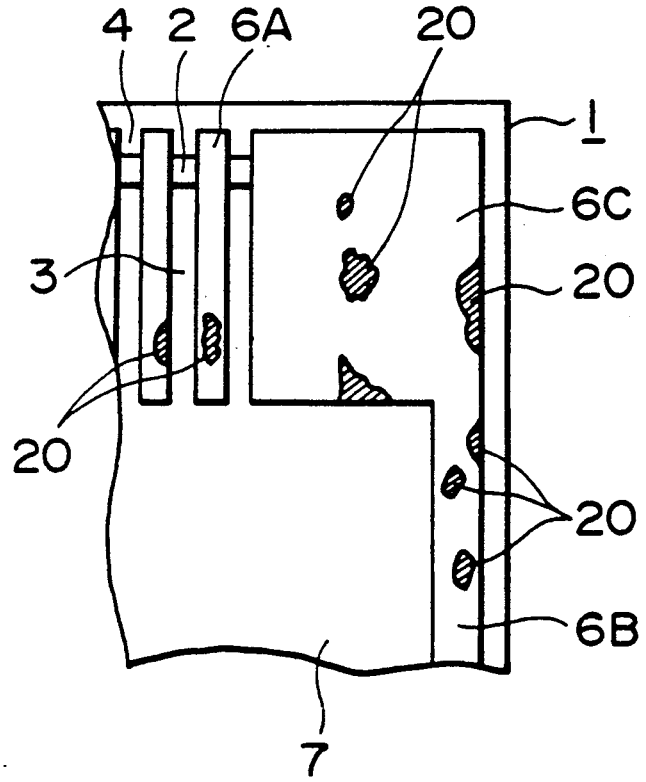
FIG. 4 PRIOR ART
FIG. 4 is a plan view schematically showing an example of the defective state occurring in the joined surface of the liquid discharge recording head according to the prior art.

The examination after the cementing was carried out with observation being effected from the upper surface of the lid plate 7 by means of a metallurgical microscope and the number of places in which drawbacks such as residual air occurred was counted. FIG. 4 schematically shows an example of the drawback which occurred near the corner wall 6C of FIG. 1. That is, portions 20 indicated by hatching in FIG. 4 show the non-intimate contact portions which occurred due to the presence of residual air.

As is apparent from Table 1, in the examples wherein the dimensional ratio between the smallest portion and the largest portion of the flow path walls, the surrounding wall and the support wall which are formed of the photosensitive resin hardening film is 3 or greater (i.e., Experiments Nos. 1, 2, 6, 7 and 8), a number of drawbacks occurred, whereas in the examples wherein said dimensional ratio is 2 or less (i.e., Experiments Nos. 3, 4, 5, 9 10 and 11), the number of drawbacks is sharply decreased. Particularly, in the examples wherein said dimensional ratio is 1 (i.e., Experiments Nos. 4 and 10) and the examples wherein said dimensional ratio LA/LB is 2 (i.e., Experiments Nos. 5 and 11), the number of drawbacks is remarkably small and the reliability of the joined surface may be said to be very high.

In the present embodiment, as the cementing method, description has been made of a case where a photosensitive resin layer is provided on the joined surface of the lid plate 7 and this is joined to the upper surface of the above-described walls formed of the photosensitive resin hardening film, whereafter light is applied thereto to harden the same, whereas the present invention is not restricted to the product made by such a cementing method, but of course can also be effective for a product made by the following method:

(1) spinner-coating the joined surface of the lid plate with an epoxy or acrylic adhesive agent to a thickness of 3–4 μ, joining it to the upper surface of the wall of said photosensitive resin hardening film, and hardening the adhesive agent;

(2) spinner-coating the adhesive agent mentioned under item (1) above, preliminarily heating the adhesive agent and transforming it into a so-called B-stage, joining it to the upper surface of the wall of the photosensitive resin hardening film and essentially hardening said adhesive agent; and (3) heat-fusing the lid plate formed of a thermoplastic resin such as acrylic resin, ABS resin or polyethylene directly onto the upper surface of the wall of the photosensitive resin hardening film.

Also, where a hardened film of photosensitive resin is used as the lid plate, a photosensitive resin film may be simply cemented to a wall formed of a photosensitive resin hardening film, whereafter the photosensitive resin may be hardened by light.

Further, where a photosensitive resin film is used for the joining of the lid plate, it is desirable to provide photosensitive resin films on the opposite surfaces of the lid plate. This is because the contracting force or the like resulting from the hardening of the photosensitive resin films is offset to enable more reliable joining to be accomplished.

Of course, the hardening of the photosensitive resin may be accomplished not only by the application of light energy but also by the application of heat energy used with the application of light energy.

According to the present invention, as described above, liquid flow paths and/or a liquid chamber communicating therewith is formed between wall portions formed of a hardened film of photosensitive resin and a substrate and a lid plate provided on said wall portions, and the maximum wall width of the wall portions of the liquid discharge recording head which can be made unitary as a recording head is two times or less the minimum wall width and therefore, when joining the lid plate to the upper surface of the wall portions of the substrate side, occurrence of drawbacks such as residual bubbles can be suppressed to ensure a good adhering state to be maintained, and this leads to the provision of a highly reliable recording head.

Further, according to the present invention, not only the peeling-off of the lid plate but also the distortion of the recording head resulting from the difference in area of adhesion is eliminated, and this also leads to the provision of a highly reliable recording head having an excellent recording characteristic.

What I claim is:

1. A liquid ejection recording head comprising a supporting substrate, a lid member and a wall portion between said supporting substrate and said lid member, wherein:

said wall portion includes a number of adjacent wall members;

a first plurality of said wall members comprises an array of flow path walls forming flow paths having heat generating elements associated therewith, said flow paths being disposed in communication with a liquid chamber and with the exterior of the recording head at orifices for discharging liquid upon actuation of said heat generating elements;

a second plurality of said wall members comprises plural support walls disposed at each side of said array and spaced from said array to form open channels; and said wall portion and said lid member include cured films of photosensitive resin.

2. A liquid ejection recording head according to claim 1, wherein:

said wall portion further includes a surrounding wall to provide the liquid chamber between said supporting substrate and said lid member; and the outermost said support walls are integral with said surrounding wall.

3. A liquid ejection recording head according to claim 2, wherein the maximum width of said wall members is two times or less the minimum width thereof and said maximum width is no greater than 200 μm.

4. A liquid ejection recording head according to claim 3, wherein said maximum width of said wall members is less than about 100 μ.

5. A liquid ejection recording head according to claim 4, wherein said maximum width of said wall members is less than about 50 μ.

6. A liquid ejection recording head according to claim 5, wherein said maximum width of said wall members is less than about 25 μ.

7. A liquid ejection recording head according to claim 1, wherein said lid member is formed of a hardened film of photosensitive resin.

8. A liquid ejection recording head according to claim 1, wherein said lid member is formed of a material selected from among glass, ceramics, metals and plastics.

9. A liquid ejection recording head according to claim 8, wherein a photosensitive resin hardening film is provided between said lid member and said wall portion.

10. A liquid ejection recording head according to claim 8, wherein an adhesive layer is provided between said lid member and said wall portion.

11. A liquid ejection recording head according to claim 1, wherein a like plurality of said support walls is disposed at each side of said array.

12. A liquid ejection recording head according to claim 1, wherein said channels are open at one end thereof and closed at the other end thereof.

13. A liquid ejection recording head according to claim 12, wherein said open ends of said channels formed by said second plurality of wall members are in communication with the exterior of the recording head and said closed ends of said channels maintain said channels out of communication with said liquid chamber.

14. A liquid ejection recording head according to claim 1, wherein said heat generating elements are arranged parallel to the direction in which said array extends and are disposed in substantially the same relative position in each flow path.

15. A liquid ejection recording head according to claim 1, wherein a like plurality of substantially similar wall members is disposed at each side of said array.

16. A liquid ejection recording head comprising a supporting substrate, a lid member and a wall portion between said supporting substrate and said lid member, wherein:

said wall portion includes a number of adjacent wall members;

a first plurality of said wall members comprises an array of flow path walls forming flow paths having energy generating elements associated therewith, said flow paths being disposed in communication with a liquid chamber and with the exterior of the recording head at orifices for discharging liquid upon actuation of said energy generating elements; and a second plurality of said wall members comprises plural support walls disposed at each side of said array and spaced from said array to form open channels.

17. A liquid ejection recording head according to claim 16, wherein each said flow path corresponds to one said energy generating element.

18. A liquid ejection recording head according to claim 16, wherein said wall members are substantially parallel and there is a plurality like of said support walls disposed at each side of said array.

19. A liquid ejection recording head according to claim 16, wherein said energy generating elements include heat generating elements.

20. A liquid ejection recording head according to claim 16, wherein said wall portion and said lid member include cured films of photosensitive resin.

21. A liquid ejection recording head according to claim 16, wherein said channels are open at one end thereof and closed at the other end thereof.

22. A liquid ejection recording head according to claim 21, wherein said open ends of said channels formed by said second plurality of wall members are in communication with the exterior of the recording head and said closed ends of said channels maintain said channels out of communication with said liquid chamber.

23. A liquid ejection recording head comprising a supporting substrate, a lid member and a wall portion between said supporting substrate and said lid member, wherein:

said wall portion includes a number of adjacent wall members;

a first plurality of said wall members comprises an array of flow path walls forming flow paths having energy generating elements associated therewith, said flow paths being disposed in communication with a liquid chamber and with the exterior of the recording head at orifices for discharging liquid upon actuation of said energy generating elements;

a second plurality of said wall members comprises plural support walls disposed at each side of said array and spaced from said array to form open channels; and the maximum width of said wall members is two times or less the minimum width thereof and said maximum width is no greater than 200 μm.

24. A liquid ejection recording head according to claim 23, wherein each said flow path corresponds to one said energy generating element.

25. A liquid ejection recording head according to claim 23, wherein said wall members are substantially parallel and there is a like plurality of said support walls disposed at each side of said array.

26. A liquid ejection recording head according to claim 23, wherein said energy generating elements include heat generating elements.

27. A liquid ejection recording head according to claim 23, wherein said wall portion and said lid member include cured films of photosensitive resin.

28. A liquid ejection recording head according to claim 23, wherein said maximum width of said wall members is less than about 50 μm and all of said wall members have substantially the same width.

29. A liquid ejection recording head according to claim 28, wherein said maximum width of said wall members is less than about 254 μm and all of said wall members have substantially the same width.

30. A liquid ejection recording head according to claim 26, wherein said channels are open at one end thereof and closed at the other end thereof.

31. A liquid ejection recording head according to claim 30, wherein said open ends of said channels formed by said second plurality of wall members are in communication with the exterior of the recording head and said closed ends of said channels maintain said channels out of communication with said liquid chamber.

32. A liquid ejection recording head comprising a supporting substrate, a lid member and a wall portion between said supporting substrate and said lid member, wherein:

said wall portion includes a surrounding wall forming a liquid chamber between said supporting substrate and said lid member and an enclosing wall disposed around said surrounding wall to provide a gap between said surrounding wall and said enclosing wall, said gap being in communication with the exterior of the recording head through an opening in said enclosing wall;

said wall portion further includes a number of adjacent wall members;

a first plurality of said wall members comprises an array of flow path walls forming flow paths having energy generating elements associated therewith, said flow paths being disposed in communication with said liquid chamber and with the exterior of the recording head at orifices for discharging liquid upon actuation of said corresponding energy generating elements; and a second plurality of said wall members comprises plural support walls disposed at each side of said array and spaced from said array to form open channels.

33. A liquid ejection recording head according to claim 32, wherein each said flow path corresponds to one said energy generating element.

34. A liquid ejection recording head according to claim 32, wherein said wall members are substantially parallel and there is a like plurality of said support walls disposed at each side of said array.

35. A liquid ejection recording head according to claim 32, wherein said energy generating elements include heat generating elements.

36. A liquid ejection recording head according to claim 32, wherein said wall portion and said lid member include cured films of photosensitive resin.

37. A liquid ejection recording head according to claim 32, wherein the maximum width of said wall portion is two times or less the minimum width thereof and said maximum width is no greater than 200 μm.

38. A liquid ejection recording head according to claim 37, wherein said maximum width is less than about 50 μm and all of said wall portion has substantially the same width.

39. A liquid ejection recording head according to claim 37, wherein said maximum width is less than about 25 μm and all of said wall portion has substantially the same width.

40. A liquid ejection recording head according to claim 32, wherein said channels are open at one end thereof and closed at the other end thereof.

41. A liquid ejection recording head according to claim 40, wherein said open ends of said channels formed by said second plurality of wall members are in communication with the exterior of the recording head and said closed ends of said channels maintain said channels out of communication with said liquid chamber.

* * * * *

UNITED STATES PATENT AND TRADEMARK OFFICE

CERTIFICATE OF CORRECTION

PATENT NO. : 5,017,947

DATED : May 21, 1991

INVENTOR(S) : KAZUAKI MASUDA

It is certified that error appears in the above-identified patent and that said Letters Patent is hereby corrected as shown below:

COLUMN 3

Line 31, "4" should read --3--.
Line 32, "4," should read --3,--.

COLUMN 4

Line 22, "denote," should read --denote--.
Line 24, "6C comprise, whicn" should read --6C, which--.
Line 26, "head, support" should read --head, comprise support--.
Line 37, "both ends" should read --each side--.
Line 38, "are maintained" should read --are closed at one end, in this embodiment being maintained--.
Line 39, "open" should read --open at the other end, in this embodiment--.

COLUMN 8

Line 30, "plurality like" should read --like plurality--.

UNITED STATES PATENT AND TRADEMARK OFFICE

CERTIFICATE OF CORRECTION

PATENT NO. : 5,017,947

DATED : May 21, 1991

INVENTOR(S) : KAZUAKI MASUDA

It is certified that error appears in the above-identified patent and that said Letters Patent is hereby corrected as shown below:

COLUMN 9

Line 20, "254 μm" should read --25 μm--.
Line 23, "claim 26," should read --claim 23,--.

Signed and Sealed this

Nineteenth Day of January, 1993

*Attest:*

DOUGLAS B. COMER

*Attesting Officer*

*Acting Commissioner of Patents and Trademarks*